US005187822A

United States Patent [19]

Merry

[11] Patent Number: 5,187,822

[45] Date of Patent: Feb. 23, 1993

[54] PORTABLE PATIENT CRANE

[75] Inventor: Donald D. Merry, Fenton, Mich.

[73] Assignee: Anodyne Corporation, Whitmore Lake, Mich.

[21] Appl. No.: 792,359

[22] Filed: Nov. 14, 1991

[51] Int. Cl.[5] ..... A61G 7/10

[52] U.S. Cl. ..... 5/86.1; 5/83.1; 414/921

[58] Field of Search ..... 5/86.1, 87.1, 83.1, 5/81.1; 254/120, 124, 323; 269/17; 280/32.5, 79.3; 248/129; 98, 97; 414/921, 345, 540

[56] References Cited

U.S. PATENT DOCUMENTS

| | | | |
|---|---|---|---|
| 1,061,715 | 5/1913 | Allen | 5/86.1 |
| 1,641,388 | 9/1927 | Jenkins | 5/86.1 |
| 1,782,406 | 11/1930 | Bureau | 5/86.1 |
| 1,878,785 | 9/1932 | Leavitt | 5/86.1 |
| 2,634,431 | 4/1953 | Bickford | 5/86.1 |
| 3,938,820 | 2/1976 | Nabinger | 5/86.1 |
| 4,117,561 | 10/1978 | Zamotin | 5/83.1 |
| 4,190,233 | 2/1980 | Godfrey | 254/124 |
| 4,484,366 | 11/1984 | Koontz | 5/83.1 |

FOREIGN PATENT DOCUMENTS

| | | | |
|---|---|---|---|
| 1104138 | 4/1961 | Fed. Rep. of Germany | 280/79.3 |
| 1461325 | 12/1961 | France | 280/79.3 |
| 704508 | 2/1954 | United Kingdom | 254/124 |

*Primary Examiner*—Renee S. Luebke
*Assistant Examiner*—F. Saether
*Attorney, Agent, or Firm*—Reising, Ethington, Barnard, Perry & Milton

[57] ABSTRACT

A portable patient lifting assembly (10) of the type for lifting and transporting a patient comprises a moveable base (12), an upstanding support member (14) rigidly fixed to the base and extending generally upwardly therefrom and a cantilevered support member (16) extending in cantilevered fashion from the upstanding support member. The assembly is characterized by the upstanding support member (14) and the cantilevered support member (16) being integrally interconnected for preventing all relative movement therebetween so that the cantilevered support member (16) is fixed relative to the upstanding support member (14). The assembly also includes lifting means (18) for raising and lowering a patient suspending from the fixed cantilevered support (16) to and away from the cantilevered support.

32 Claims, 1 Drawing Sheet

PORTABLE PATIENT CRANE

FIELD OF THE INVENTION

The subjection invention relates to portable patient cranes of the type for raising a hospital patient from a resting position, transporting the patient across a flat surface, and lowering the patient to another resting position.

BACKGROUND OF THE INVENTION

Hospitals, nursing homes, private homes and all other places likely to house invalids require a means for transporting partially or fully immobilized patients from one location to another. In some situations, a patient may be transferred with a fixed gantry assembly of the type shown in U.S. Pat. No. 5,038,425 to Merry.

Other circumstances require that the patient mover itself be mobile. This occurs when a patient must be moved from one room to another, from one floor to another, from one building to another and so on. Several patient movers currently find use in various health care environments providing such services. These patient movers are disclosed in U.S. Pat. No. 3,104,399 to Dalton, U.S. Pat. No. 3,222,029 to Hildeman and U.S. Pat. No. 3,659,594 to Schwab. All of these patient lifters are of the crane type including a base portion having wheels, an upright support for supporting the patient a given distance above the base, and a cantilevered boom extending over the base for raising and lowering the patient. The cantilevered portion typically pivots with respect to the upright support when the patient is either raised or lowered by the cantilevered boom.

However, it is not necessary for the boom to move in order to raise and lower a patient. In fact, the pivoting of the boom creates an unstable situation in which the assembly can topple and whereby the patient could be injured. Moreover, the pivoting boom assemblies cannot lift significant loads.

SUMMARY OF THE INVENTION

A portable patient lifting assembly of the type for lifting and transporting a patient comprises a moveable base, an upstanding support member rigidly fixed to the base and extending generally vertically and upwardly therefrom and a cantilevered support member extending in cantilevered fashion from the upstanding support member. The assembly is characterized by the upstanding support member and the cantilevered support member being integrally interconnected for preventing all relative movement therebetween so that the cantilevered support member is fixed relative to the upstanding support member. The assembly finally includes lifting means for raising and lowering the patient suspending from the fixed cantilevered support toward and away from the cantilevered support.

This arrangement makes for a more stable lifting assembly, and one capable of lifting heavier loads.

FIGURES IN THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
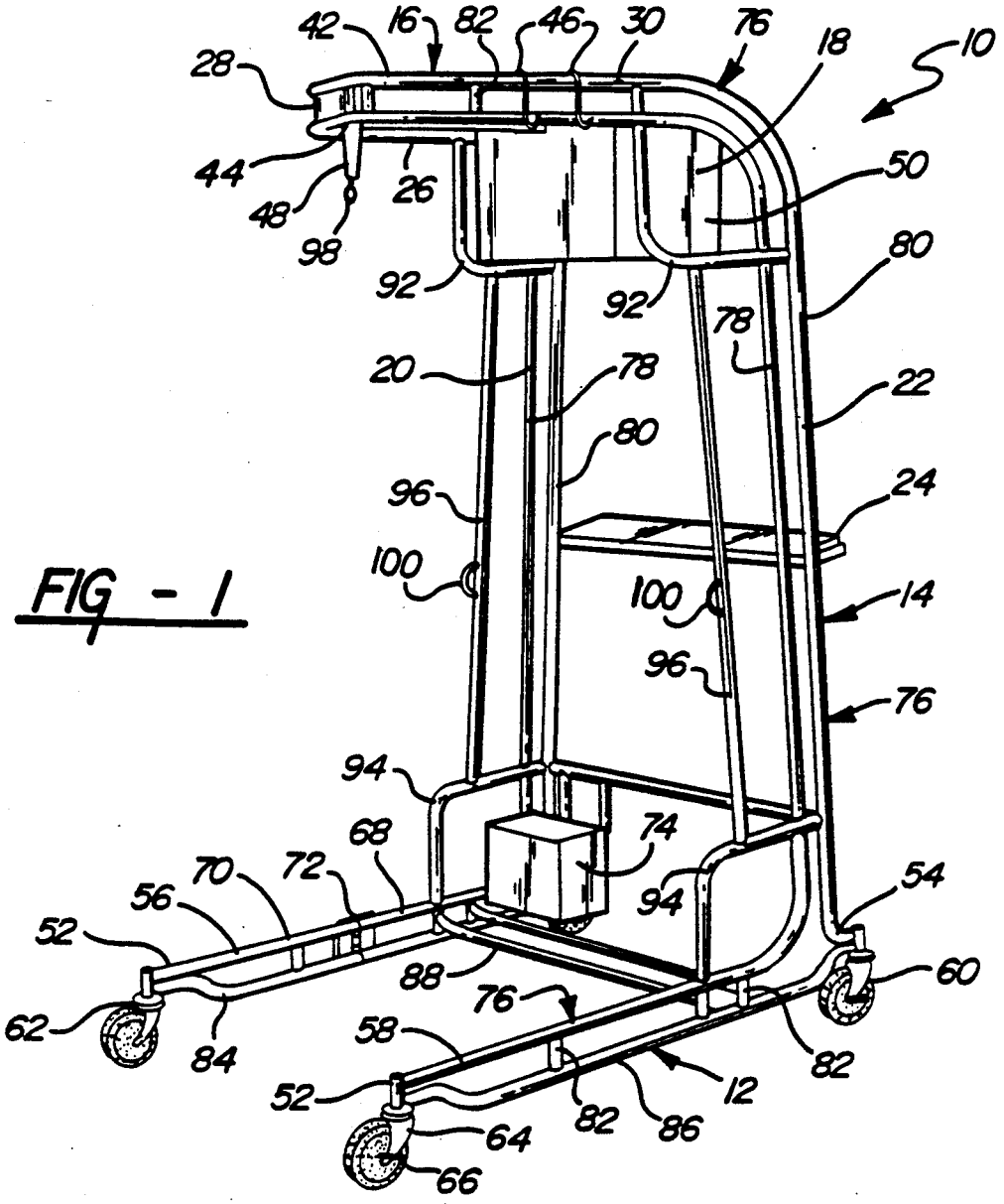
FIG. 1 is a perspective view of the portable patient crane.
Figure 2:
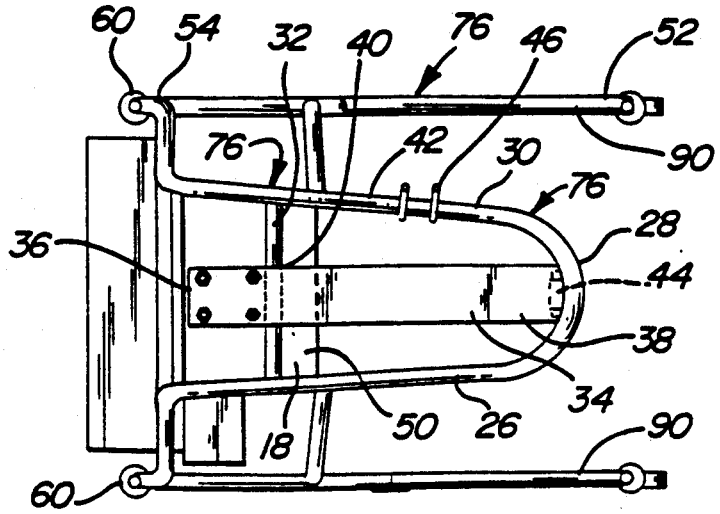
FIG. 2 is a top view of the portable patient crane.

A portable patient lifting assembly generally shown at 10 of the type for lifting and transporting a patient comprises a moveable base generally indicated at 12, an upstanding support member generally indicated at 14 rigidly fixed to the base and extending generally vertically upwardly therefrom and a cantilevered support member generally indicated at 16 extending in cantilevered fashion from the vertical upstanding support member. The assembly 10 is characterized by the upstanding support member 14 and the cantilevered support member 16 being integrally interconnected for preventing all relative movement therebetween so that the cantilevered support member 16 is fixed relative to the upstanding support member 14. The assembly also includes lifting means 18 extending inwardly from the cantilevered support member 16 for raising and lowering a patient suspended from the fixed cantilevered support toward and away from the cantilevered support.

The upstanding support member 14 includes a first leg 20 extending upwardly from the base 12 toward the cantilevered support 16 and a second leg 22 extending upwardly from the base toward the cantilevered support and spaced apart from the first leg 20. The first and second legs 20,22 extend up and toward each other. In other words, the legs 20,22 are closer to each other adjacent the cantilevered support 16 than they are at the base 12. This arrangement of the legs 20,22 contributes to the overall stability of the assembly 10. Because the legs 20,22 slant toward each other as they leave the base, they tend to resist destabilizing forces resulting if the patient swings across the base 12 in a pendulum-like manner. This arrangement of the legs 20,22 is more stable than if there was a single pole acting as the upstanding support member 14.

The upstanding support 14 includes a convenience tray 24 disposed horizontally between the first leg 20 and the second leg 22.

The cantilevered support 16 includes a first arm 26 extending horizontally out over the base 12 from the first leg 20 to a patient suspending end 28 and a second arm 30 extending horizontally out over the base 12 from the second leg 22 to the patient suspending end. The first and second arms 26,30 are closer together at the patient suspending end 28 than near the first and second legs 20,22. In fact, the first and second arms 26,30 converge at the patient suspending end 28. A rib member 32 is disposed between and transverse to the arms 26,30 between the patient suspending end 28 and the legs 20,22. In this embodiment the rib member 32 has a somewhat circular cross section. The cantilevered support 16 further includes a spine member 34 having a first end 36 disposed adjacent to the rib member 32 and a second end 38 fixed to the patient suspending end 28, usually by welding. The spine member 34 is preferably a metal "U" channel member having an upside down "U" shaped cross section. The spine member 34 includes a hole 40 drilled transverse to the member through each of the legs of the "U." The rib member 32 passes through the spine 34 through this hole 40, and the rib member is welded to the spine at the points through which the rib passes. The first end 36 of the spine 34 actually extends past the rib member 32 toward the legs 20,22 of the upstanding support member 14. The cantilevered support 16 comprises a single member 42 being bent in half to include a bend, a first end and a second end so that the bend forms, or occurs at the patient suspending end 28, the first end forms the first arm 26 and the second end forms the second arm 30. A pulley 44 is disposed on the spine member 34 adjacent the patient suspending end 28. Travelling hanging means 46 suspends from and is free to travel linearly along the single member 42 for supporting flexible tubes and wires which lead to the patient. The travelling hanging means 46 are "S" shaped metal hooks. The hooks suspend from the single member with one loop of the "S." The other loop is free to support tubes or wires or other patient appurtenances which hang from or drape over the loop.

The lifting means 18 includes the cord 48 and a hoist 50 attached to the cord for taking up and letting out the cord. The hoist 50 is mounted on the spine member 34 at the first end 36 of the spine member. The hoist 50 is bolted or otherwise secured to the spine member 34 behind where the rib 32 passes through. The cord 48 extends from the hoist 50 and through the pulley 44 for raising and lowering the patient toward and away from the cantilevered support 16. The cord 48 is generally a fabric strap. It includes a hook or clip 98 disposed on the end outside the hoist 50 for attaching to a patient chair or sling assembly. The pulley 44 must be suitable for supporting such a strap 48. Any hoist 50 may be used—power or manual. The preferred hoist 50 is of the type disclosed in the U.S. Pat. No. 5,038,425 to Merry, the teachings of which are incorporated herein by reference. The hoist 50 could be mounted elsewhere on the assembly 10 with some minor engineering changes.

The base 12 includes a front end 52 and a rear end 54 disposed adjacent the legs 20,22. The rear end 54 is only that end which is behind the legs 20,22. The base 12 further includes first 56 and second 58 spaced apart feet extending in parallel fashion from the legs 20,22 parallel to and under the cantilevered support 16 toward the front end 52. The base 12 includes two rear wheels 60 disposed on the rear end 54 of the base and spaced apart from one another for rollably supporting the base 12 above a floor. Generally one wheel 60 is disposed adjacent the first leg 20 and the other wheel 60 is disposed adjacent the second leg 22.

The first foot 56 includes a first front wheel 62 disposed at the front end 52 for rollably supporting the base 12 above the floor. The second foot 58 includes a second front wheel 64 disposed at the front end 52 for rollably supporting the base 12 above the floor. In the preferred embodiment, the first and second front wheels 62,64 are adapted to swivel with respect to the feet 56,58, although the rear wheels 60 could swivel instead. Foot operated brakes 66 should be included on at least the rear wheels 60 to prevent the assembly 10 from moving when unattended. In general, the feet 56,58 need to be spaced far enough apart to allow a wheelchair to fit in between. In one embodiment of the invention, the feet 56,58 are spaced far enough apart for this to happen easily. In a smaller embodiment, one of the feet 56,58 needs to pivot out to create enough space for the chair. One of the first and second feet 56,58 includes a rear length 68 and a separate front length 70 attached to the rear length 68 with a hinge 72 allowing the front length 70 to pivot with respect to the rear length 68 in order to increase the distance between the first and second spaced apart feet 56,58. The larger embodiment, having the feet 56,58 spread farther apart, has no need of a hinge since the feet are already far enough apart to surround a wheelchair. The larger embodiment tends to be more stable since its base is wider and since one leg does not need to pivot to make room for the wheelchair.

The base 12 also includes a spare battery box 74 disposed on the rear end 54 of the base. This is a stainless or other metal type box. The spare battery is useful in institutional settings where the battery in the hoist 50 gets a great deal of use.

Preferably, the frame of the assembly 10 includes a continuous member 76 which extends vertically to form the first leg 20 of the upstanding support 14, and out horizontally therefrom to form the first arm 26 of the cantilevered support 16, back horizontally therefrom to form the second arm 30 of the cantilevered support, and down therefrom to form the second leg 22 of the upstanding support 14 generally parallel to the first leg 20. The continuous member 76 acts in the place of the single member 42 of the cantilevered support 16. The continuous member 76 comprises a first tube 78 and a second tube 80 whereby the first and second tubes are parallel to one another. The first and second tubes 78,80 are attached to one another and spaced apart a predetermined distance by spacer pegs 82. The spacer pegs 82 are short lengths of chrome plated metal tube similar to that used elsewhere in the assembly 10. These pegs are generally welded to the tubes 78,80. The first tube 78 splits apart from the second tube 80 where the first leg 20 extends from the base 12, with the first tube 78 extending horizontally toward the front end 52 to form the first foot 56 and with the second tube 80 extending toward the rear end 54. The first tube 78 also splits apart from the second tube 80 where the second leg 22 extends from the base 12 with the first tube 78 extending horizontally out toward the front end 52 to form the second foot 58 and with the second tube 80 extending horizontally toward the rear end 54. So, in a sense the cantilevered portion 16, the upstanding support 14 and the base 12 are integral because they share the continuous member 76. The tubes 78,80 here should be made from chrome plated metal or other material which can be easily sterilized.

The base 12 further includes a first lower support 84 disposed adjacent the first leg 20 and extending between the front and rear ends 52,54 under and parallel to the first and second tubes 78,80 as the tubes extend horizontally. There is also a second lower support 86 disposed adjacent the second leg 22 and extending between the front and rear ends 52,54 under and parallel to the first and second tubes 78,80 as the tubes extend horizontally and parallel to the first lower support 84. The lower supports 84,86 are disposed between the legs 20,22 and the surface on which the base 12 rests. The lower supports 84,86 are fixed to the legs by chrome tube spacer pegs 82. The base 12 includes at least one cross support 88 extending between the first and second feet 56,58 so that the cross support 88 and the feet form a chair receiving space 90. The preferred embodiment includes two parallel cross supports. As mentioned earlier, there must be a space 90 between the feet 56,58 to receive a chair so that a patient can easily be transferred between the portable patient crane 10 and the chair. The pieces mentioned in this paragraph should also be made from chrome plated metal or other material which is easy to sterilize or clean.

The assembly also includes fixed brace means 92 disposed between the first leg 20 of the upstanding support 14 and the first arm 26 of the cantilevered support 16 and between the second leg 22 of the upstanding support on the second arm 30 of the cantilevered support for fixedly supporting the cantilevered support member 16 with respect to the upstanding support member 14. These two pieces 92 each extend perpendicularly out from said upstanding support 14, bend ninety degrees and meet the cantilevered portion 16 perpendicular to the cantilevered portion. These brace means 92 are welded to the cantilevered member 16 and to the upstanding support 14. They should be made from chrome plated metal or other material which can be easily sterilized or cleaned.

The assembly further includes fixed reinforcing means 94 disposed between the first foot 56 of the base 12 and the first leg 20 of the upstanding support member 14, and also between the second foot 58 of the base and the second leg 22 of the upstanding support member for fixedly supporting the upstanding support member with respect to the base. The fixed reinforcing means 94 are each welded to the base 12 and to the upstanding support member 14. These two pieces 94 extend perpendicularly out from the upstanding support 14, bend ninety degrees and meet the base portion 12 perpendicular to the base portion. The assembly finally includes prop means 96 extending vertically between the fixed reinforcing means 94 and fixed brace means 92 for further stabilizing the patient crane assembly 10. The prop means 96 are welded to the brace means 92 and reinforcing means 94 adjacent to where each of these pieces bend. The brace means 92, the reinforcing means 94 and the prop means 96 together serve to counter the effect of a load on the patient supporting end of the cantilevered support 16. These pieces 92,94,96 should be made from chrome plated metal or other material which can be easily sterilized or cleaned.

Rings 100 are placed on each of the prop means 96 at about the midpoint of their length. The rings are adapted to receive straps which attach at one end to the patient chair and at the other end to the prop means 96. These straps serve to prevent the patient from swaying laterally and affecting the stability of the entire assembly 10. The rings 100 may be attached to the prop means 96 in any fashion, including welding. The rings 100 may also be attached anywhere else on the assembly 10, including on the base, where they may work together with straps to secure the patient with respect to the assembly 10.

The frame of the assembly need not be made from tubes 78,80 as shown in the drawings. The single continuous member 76 can be a bulkier shape, or a shape having for example a rectangular rather than a circular cross section.

The frame of the portable patient crane 10 has the shape of a sideways "U" when viewed in profile. This is important because the crane 10 must be adapted to raise and lower a patient from a bed. With this assembly, the feet 56,58 can fit under a raised bed as the cantilevered portion 16 moves over the bed to raise and lower the patient over the bed.

Perhaps the fundamental feature of the frame design is its stability. This derives partly from the fact that the cantilevered portion 16 cannot move with respect to the upstanding support member 14. The cantilevered support member 16 is integral with the upstanding support member 14. Whereas the prior art crane lift the patient with a cantilevered boom that pivots with respect to an upstanding support member, the subject invention's cantilevered portion 16 does not pivot with respect to the upstanding support member 14. The cantilevered portion 16 is fixedly secured to the upstanding support member 14. The cantilevered portion 16 is immovably disposed with respect to the upstanding support member 14. Whereas the patient does not move any closer to the cantilevered boom in the prior art when the patient is being lifted, the patient does move closer to or farther from the cantilevered support member 16 when being raised or lowered. In the prior art, the hoisting mechanisms move the cantilevered boom and the patient suspending therefrom. In the subject invention, the hoist 50, whether manual or electric, lifts only the patient toward or away from the cantilevered support 16.

The entire frame of the assembly 10, including the base 12, the upstanding support member 14 and the cantilevered support member 16, is integral: none of these three parts move with respect to any of the other parts. It has been disclosed that the cantilevered support 16 is rigidly attached, i.e. positively fixed, to the upstanding support member 14. This is also true of the base 12 and the upstanding support member 14.

Another important stability feature pertains to the cantilevered support 16. In the prior art the cantilevered support is typically a single beam or boom. If the patient, suspended from the end of the boom, swings at all this swinging exerts a moment on the upstanding support member which can cause the entire assembly to tip. The subject cantilevered boom 16 includes stabilizing means 26,30 which counters any moment-producing force exerted on the end of the boom or beam by the swinging of the patient. The patient is actually suspended by the spine member 34, which acts as an equivalent of a boom or beam. But the spine member is supported in the horizontal plane by the first and second arms 26,30, which tend to counter any moment producing force exerted on the spine member 34. For example, if the patient swings to the right, as viewed by a person facing the front of the assembly, the compressive force of the second arm 30 and the tensile force of the first arm 26 will resist the tendency of the spine 34 to swing to the right. Similarly, if the patient swings to the left, the compressive force of the first arm 26 and the tensile force of the second arm 30 will resist movement of the spine 34 to the left.

Another stability feature pertains to the fact that the legs 20,22 slant toward each other as they rise from the base 12. This has been described above.

A final stability feature pertains to the rings 100 located on the upstanding support 14. These rings facilitate the connecting of securing straps between the patient chair and the assembly 10. This has also been described above.

Some type of seat or sling (not shown) should be connected to the strap coming from the hoist. Many different seats or slings could be used. The preferred seat is the three section seat suspended by the suspension assembly set forth in the U.S. Pat. No. 5,038,425 to Merry, the teachings of which are incorporated herein by reference.

The patient crane 10 may be used for example in the following manner: The crane 10 should be wheeled near a bed so that the feet 56,58 extend under and perpendicular to the bed. The patient chair should be placed under the patient lying in the bed and connected to the patient chair suspension assembly, which is suspended by the hoist strap or cord 48. The hoist 50 should then be activated to raise the chair having the patient thereon above the bed. At this point the crane 10 can be wheeled away from the bed and taken anywhere. For example, the crane 10 can be moved so that the feet 56,58 surround a patient wheel chair. The hoist 50 can be operated to lower the patient into the wheel chair. Once the patient is completely lowered the chair can be unattached from the suspension assembly and thus the crane, and the patient in the chair can be wheeled away.

The invention has been described in an illustrative manner, and it is to be understood that the terminology which has been used is intended to be in the nature of words of description rather than of limitation.

Obviously, many modifications and variations of the present invention are possible in light of the above teachings. It is therefore to be understood that within the scope of the appended claims wherein reference numerals are merely for convenience and are not to be in any way limiting the invention may be practiced otherwise than is specifically described.

What is claimed:

1. A portable element patient lifting assembly (10) of the type for lifting and transporting a patient comprising:

a moveable base (12);

an upstanding support member (14) rigidly fixed to said base (12) and extending generally vertically upwardly and over said base a cantilevered support member (16) extending in cantilevered fashion from said upstanding support member (14);

said upstanding support member including a first leg (20) extending in a substantially straight line between said base (12) and said cantilevered support member, and a second leg (22) spaced apart from said first leg extending in a substantially straight line between said base and said cantilevered support member, said first and second legs (20,22) extending toward each other as said legs rise vertically from said base (12) whereby said first and second legs define an "A" shaped frame extending above said base;

said cantilevered support including a first arm (26) extending horizontally out over said base (12) from said first leg (20) to a patient suspending end (28), and a second arm (30) extending horizontally out over said base (12) from said second leg (22) to said patient suspending end (28), said first and second arms (26,30) converging at said patient suspending end (28);

said base (12) including a first foot extending horizontally from said first leg and a spaced apart second foot extending horizontally from said second leg and parallel to said first foot, said first and second feet defining a space for receiving a hospital chair therebetween;

a rigid connection for rigidly interconnecting said upstanding support member (14) and said cantilevered support member (16) for preventing any movement therebetween;

said assembly further including lifting means (18) for raising and lowering a patient to and from said cantilevered support (16).

2. An assembly (10) as set forth in claim 1 further characterized by said assembly (10) including connecting means (100) for connecting straps to said assembly (10) so that the straps may extend between the patient and said assembly (10) and secure the patient from moving laterally with respect to said assembly.

3. An assembly (10) as set forth in claim 2 further characterized by said connecting means (100) including rings (100) fixed to said upstanding support member (14).

4. An assembly (10) as set forth in claim 1 further characterized by including a rib member (32) disposed between and transverse to said first and second arms (26,30) between said patient suspending end (28) and said first and second legs (20,22).

5. An assembly (10) as set forth in claim 4 further characterized by including a spine member (34) having a first end (36) disposed adjacent to said rib member (32) and a second end (38) fixed to said patient suspending end (28).

6. An assembly (10) as set forth in claim 5 further characterized by said cantilevered support (16) including a single member (42) being bent in half to include a bend, a first end and a second end so that said bend forms said patient suspending end (28), said first end forms said first arm (26), and said second end forms said second arm (30).

7. An assembly (10) as set forth in claim 6 further characterized by including a pulley (44) disposed on said spine member (34) adjacent said patient suspending end (28).

8. An assembly (10) as set forth in claim 7 further characterized by including a cord (48) and a hoist (50) attached to said cord for taking up and letting out said cord.

9. An assembly (10) as set forth in claim 8 further characterized by said hoist (50) being mounted on said spine member (34) adjacent said second end (38) of said spine member (34).

10. An assembly (10) as set forth in claim 9 further characterized by said cord (48) extending from said hoist (50) and through said pulley (44) for raising and lowering the patient toward and away from said cantilevered support (16).

11. An assembly (10) as set forth in claim 10 further characterized by said base (12) including a front end and a rear end disposed adjacent said legs.

12. An assembly (10) as set forth in claim 11 further characterized by said base (12) including two rear wheels (60) disposed on said rear end (54) of said base (12) and spaced apart from one another for rollably supporting said base above a floor.

13. An assembly (10) as set forth in claim 12 further characterized by said first foot (56) including a first front wheel (62) disposed at said front end (52) for rollably supporting said base (12) above a floor.

14. An assembly (10) as set forth in claim 13 further characterized by said second foot (58) including a second front wheel (64) disposed at said front end (52) for rollably supporting said base (12) above a floor.

15. An assembly (10) as set forth in claim 14 further characterized by said front wheels (62,64) being adapted to swivel with respect to said feet (56,58).

16. An assembly (10) as set forth in claim 15 further characterized by including a convenience tray (24) disposed horizontally between said first leg (20) and said second leg (22).

17. An assembly (10) as set forth in claim 16 further characterized by one of said first and second feet (56,58) including a rear (68) and a separate front (70) length hinged to said rear length with a hinge (72) allowing said front length (70) to pivot with respect to said rear length (68) in order to increase the distance between said first and second spaced apart feet (56,58).

18. An assembly (10) as set forth in claim 17 further characterized by including travelling hanging means

(46) suspending from and free to travel linearly along said single member (42) for supporting flexible tubes and wires.

19. An assembly (10) as set forth in claim 18 further characterized by including a spare battery box (74) disposed adjacent said rear end (54) of said base (12).

20. An assembly (10) as set forth in claim 19 further characterized by including one continuous member (76) bent to form said upstanding support (14), said cantilevered support (16) and said base (12).

21. An assembly (10) as set forth in claim 20 further characterized by said continuous member (76) extending vertically to form said first leg (20) of said upstanding support (14), out horizontally therefrom to form said first arm (26) of said cantilevered support (16), back horizontally therefrom to form said second arm (30) of said cantilevered support (16) and down therefrom to form said second leg (22) of said upstanding support (14) generally parallel to said first leg (20).

22. An assembly (10) as set forth in claim 21 further characterized by said continuous member (76) comprising a first tube (78) and a second tube (80) whereby said first and second tubes are parallel to one another.

23. An assembly (10) as set forth in claim 22 further characterized by said first and second tubes (78,80) being attached to one another and spaced apart a predetermined distance by spacer pegs (82).

24. An assembly (10) as set forth in claim 22 further characterized by said first tube (78) splitting apart from said second tube (80) where said first leg (20) extends from said base (12), with said first tube (78) extending horizontally toward said front end (52) to form said first foot (56), and with said second tube (80) extending toward said rear end (54).

25. An assembly (10) as set forth in claim 24 further characterized by said first tube (78) splitting apart from said second tube (80) where said second leg (22) extends from said base (12), with said first tube (78) extending horizontally out toward said front end (52) to form said second leg (22), and with said second tube (80) extending horizontally toward said rear end (54).

26. An assembly (10) as set forth in claim 25 further characterized by said base (12) including a first lower support (84) disposed adjacent said first leg (20) and extending between said front and rear ends (52,54) under and parallel to said first and second tubes (78,80) as said tubes extend horizontally.

27. An assembly (10) as set forth in claim 26 further characterized by said base (12) including a second lower support (86) disposed adjacent s id second leg (22) and extending between said front and rear ends (52,54) under and parallel to said first and second tubes (78,80) as said tubes extend horizontally, and parallel to said first lower support (84).

28. An assembly (10) as set forth in claim 27 further characterized by said base (12) including at least one cross support (88) extending between said first and second feet (56,58) so that said cross supports (88) and said feet form a chair receiving space (90).

29. An assembly (10) as set forth in claim 28 further characterized by including fixed brace means (92) disposed between said first leg (20) of said upstanding support (14) and said first arm of said cantilevered support (16) and between said second leg (22) of said upstanding support and said second arm of said cantilevered support (16) for fixedly supporting said cantilevered support member with respect to said upstanding support member (14).

30. An assembly (10) as set forth in claim 29 further characterized by including fixed reinforcing means (94) disposed between said first foot (56) of said base (12) and said first leg (20) of said upstanding support member (14) and between said second foot of said base (12) and said second leg (22) of said upstanding support for fixedly supporting said upstanding support member (14) with respect to said base.

31. An assembly (10) as set forth in claim 30 further characterized by including prop means (96) extending vertically between said fixed reinforcing means (94) and said fixed brace means (92) for further stabilizing said patient crane assembly (10).

32. An assembly (10) as set forth in claim 31 further characterized by said continuous member (76), said spacer pegs (82), said fixed brace means (92), said fixed reinforcing means (94), said prop means (96), said cross supports (88) said rib member (32) and said spine member (34) being made from chrome plated metal.

* * * * *